US006443088B1

(12) United States Patent
Putman et al.

(10) Patent No.: US 6,443,088 B1
(45) Date of Patent: Sep. 3, 2002

(54) GATE STOP FOR A PONTOON BOAT

(75) Inventors: David L. Putman, Rome City; Baron R. Biedenweg, Fort Wayne, both of IN (US)

(73) Assignee: Harris Kayot, Inc., Fort Wayne, IN (US)

( * ) Notice: Subject to any disclaimer, the term of this patent is extended or adjusted under 35 U.S.C. 154(b) by 0 days.

(21) Appl. No.: 09/685,925

(22) Filed: Oct. 10, 2000

(51) Int. Cl.[7] ..... B63B 8/00

(52) U.S. Cl. ..... 114/343; 114/61.1; 114/85; 114/364

(58) Field of Search ..... 114/343, 364, 114/85, 61.1; 49/381, 394

(56) References Cited

U.S. PATENT DOCUMENTS 3,630,163 A * 12/1971 Williams ..... 114/61
4,122,631 A * 10/1978 Batcheller ..... 49/394
4,548,294 A 10/1985 Ruda et al. ..... 182/206

* cited by examiner

*Primary Examiner*—Ed Swinehart
(74) *Attorney, Agent, or Firm*—Baker & Daniels

(57) ABSTRACT

The present invention involves a gate assembly for a pontoon boat. The pontoon boat includes a platform deck atop a flotation device with a protective railing having fence sections and gate assemblies at least partially surrounding the deck. The gate assembly is disposed in a gap or opening in the protective fence between two of the fence sections and includes a gate, a gate stop, and a sliding hinge. The gate is attached by the hinge to one of the two fence sections at the opening of the protective railing, and the stop is attached to the other of the two fence sections and includes a stop member extending from the deck to near the top of the fence that will prevent the gate from swinging outwardly. The stop member includes a padding strip thereon between the stop member and the gate, which prevents rattling between the stop member and the gate.

5 Claims, 2 Drawing Sheets

GATE STOP FOR A PONTOON BOAT

BACKGROUND OF THE INVENTION

1. Field of the Invention

The present invention generally relates to gates for pontoon boats, and more particularly to a gate stop for the fence gate.

2. Description of the Related Art

Current pontoon boat gates have stops that will allow the gate to swing inward toward the passenger area of the boat or outward towards the water. These stops consist of a short U-shaped metal stop located on the bottom of the fence at the gate opening. To move the gate, a person raises the gate above the stop and swings the gate open.

The problem with stops such as these is that because they are so short, they do not provide adequate support if the top of the gate is forced outward. Therefore, such stops could possibly allow a person leaning against the gate to accidently push the bottom of the gate above the stop, allowing the gate to swing outward. In addition, the space between the bottom of the gate and the stop allows the bottom of the gate to rattle within the stop when the engine of the boat is running.

SUMMARY OF THE INVENTION

The present invention involves a gate assembly for a pontoon boat. The pontoon boat includes a platform deck atop pontoons with a protective railing having fence sections and gate assemblies at least partially surrounding the deck. The gate assemblies are disposed in openings in the protective railing between two of the fence sections and include a gate, a gate latch and stop, and a sliding hinge. The gate is attached by the hinge to one of the two fence sections at the opening of the protective railing, and the stop is attached to the other of the two fence sections and includes a stop member or members that extend into the opening to prevent the gate from swinging outwardly even under considerable outward force. The stop additionally conceals the gap between the fence and the gate on the exterior or non-hinge side of the fence.

A padding strip is provided on the stop member or members to take up the spacing between the gate and the stop member and to dampen the vibrations therebetween. The padding strip thereby reduces rattling noise between the gate and the stop member when the engine of the boat is running, as well as closure noise between the gate and the stop member during closing of the gate.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
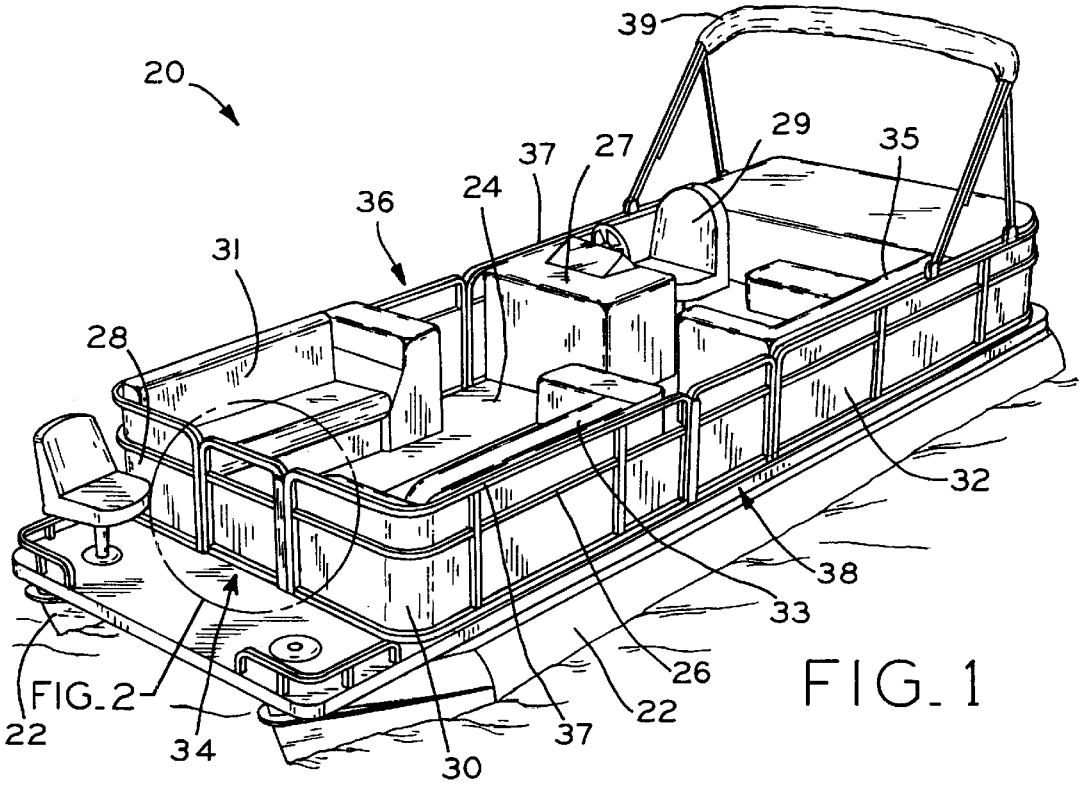
FIG. 1 is a perspective view of a pontoon boat having a gate assembly in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, in several forms, and such exemplifications are not to be construed as limiting the scope of the invention in any manner.

DETAILED DESCRIPTION

Referring to FIG. 1, a pontoon boat, in accordance with the present invention and generally referenced as 20, includes a pair of pontoons 22, a platform deck 24 disposed atop pontoons 22, and protective aluminum railing 26 partially surrounding deck 24 at the perimeter. Protective railing or fence 26 includes fence sections 28, 30, 32 and a top edge 37, and there are provided a plurality of gate assemblies 34, 36, 38 for entering and exiting the area within protective railing 26. The area within protective railing 26 contains helmstand 27 with chair 29 and a plurality of seats 31, 33, 35 and can be partially covered by bimini top 39 shown in a folded condition.

Figure 2:
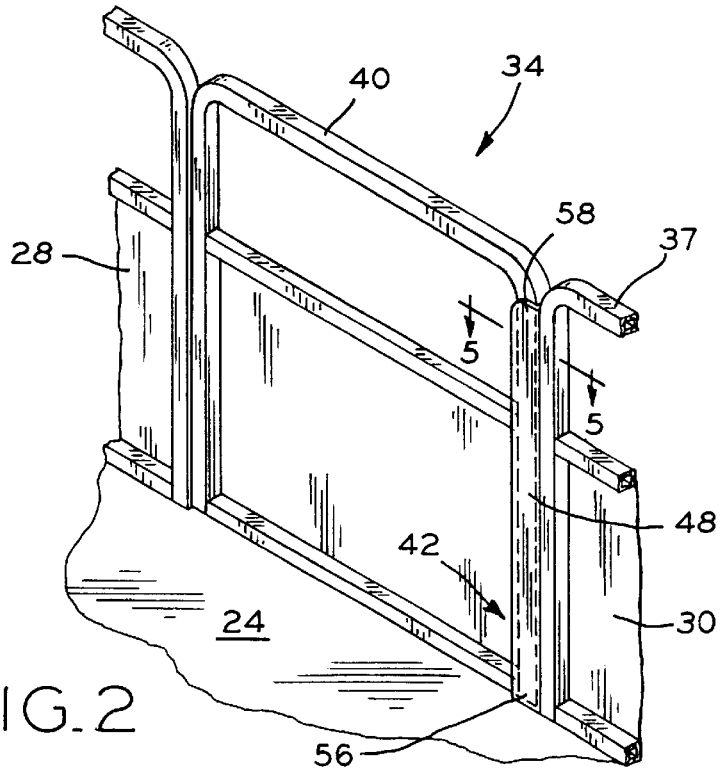
FIG. 2 is a perspective view of the gate assembly of FIG. 1, showing the gate in a closed position.
Figure 3:
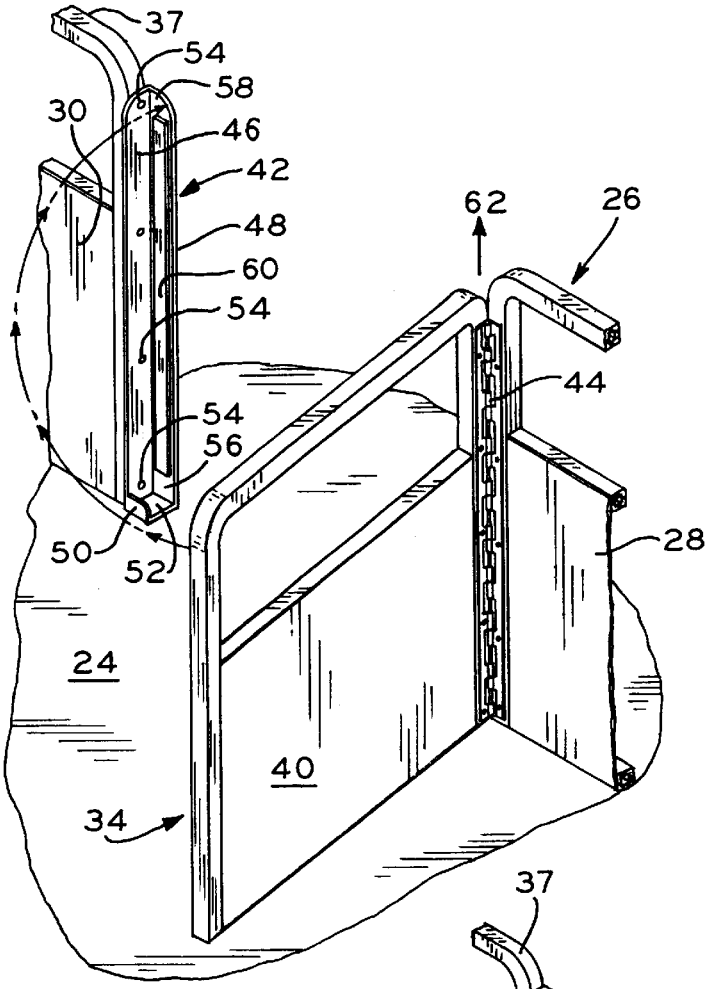
FIG. 3 is a perspective view of a first embodiment of the gate assembly from inside the boat, showing the gate in an open position.

Referring now to FIGS. 2 and 3, gate assembly 34 is disposed in a gap between fence sections 28 and 30 and includes gate 40 and aluminum gate stop 42. Gate 40 attaches to fence section 28 via sliding hinge 44 and stop 42 attaches to fence section 30 by welding, riveting, or other fasteners such as bolts and screws. Sliding hinge 44 allows gate 40 to be lifted vertically approximately one inch as shown by arrow 62 to clear latch 50. Stop 42 extends from deck 24 vertically to a position proximate the top of fence section 30, latches gate 42 in position in the gap between the fence sections, and prevents the movement of gate 40 outward.

Stop 42 is preferably one-piece and made of formed or cast metal and attaches to the fence 28, having a short lip or latch 50 on the inward side and a rail portion 48 on the outward side. The short lip 50 latches the gate closed and the rail portion 48 prevents the gate from moving outward of the fence. Latch member 50 and rail portion 48 are connected by bridge portion 52. Attachment member 46 is attached to fence section 30 with a plurality of fasteners 54, such as screws or rivets, and extends from deck 24 to near the top of fence section 30. The rail portion 48 of stop 42, includes bottom portion 56 and top portion 58 and preferably extends perpendicularly along the entirety of the outside vertical edge of attachment member 46 preventing the movement of gate 40 outward of the area within protective railing 26. Bottom portion 56 extends up from deck 24 and top portion 58 extends down from near the top of fence section 30. Latch member 50 is the short lip of stop 42 extending perpendicularly along a small portion of the inside vertical edge of attachment member 46 and acts to latch gate 40 in place adjacent rail portion 48 between fence sections 28 and 30. Bridge portion 52 extends perpendicularly along the bottom horizontal edge of attachment member 46 joining rail portion 48 to latch member 50, providing strength and support. Rail portion 98 additionally conceals the gap between fence section 28 and gate 40 when gate 40 is closed, as viewed from the outside of protective railing 26.

An alternative embodiment of the stop member is envisioned that comprises two or more short rail elements or portions spaced vertically along attachment members 46 with one portion proximate the upper edge 37 of fence 28 and the other more proximate deck 24. Each short rail element of the alternative stop member may include a padding strip thereon, such as padding strip 60, described below.

In operation, gate 34 swings on hinge 44 with rail portion of stop 42 preventing movement of gate 34 outward of the area within protective railing 26 and latching gate 34 in a position between the fence sections of protective railing 26. To latch gate 34 closed, the gate is moved to lip 50 and the gate is raised on the sliding hinge to allow the gate to be moved over lip 50 toward rail portion 48 of stop 42. Then the gate is released and allowed to lower, capturing the gate between the latch member 50 and rail portion 48. To unlatch and open the gate, the gate 34 is raised on the sliding hinge to allow the gate to be moved over the lip 50.

Figure 5:
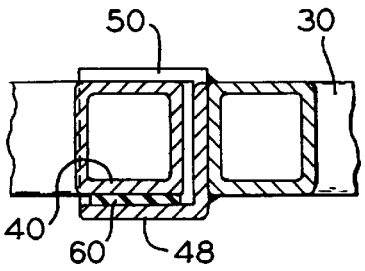
FIG. 5 is a partial sectional view taken along line 5—5 of FIG. 2, showing the gate adjacent the stop member, and a padding strip disposed between the gate and the stop member.
Figure 4:
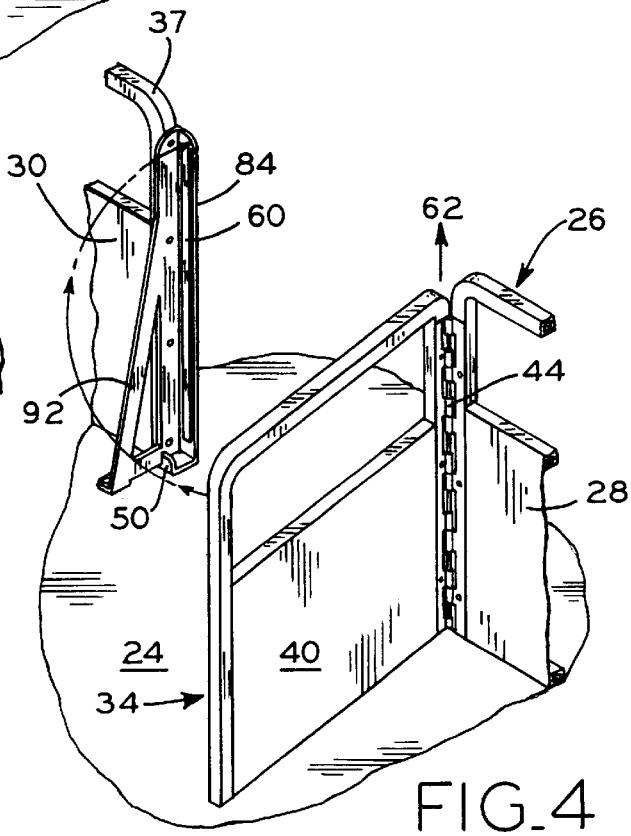
FIG. 4 is a perspective view of a second embodiment of the gate assembly from inside the boat, showing the gate in an open position.

Referring to FIGS. 3–5, rail portion 48 includes padding strip 60 thereon, which may be affixed to rail portion 48 with an adhesive or in another suitable manner. Alternatively, padding stip 60 may be affixed to gate 40. Padding strip 60 is made of a resilient, soft material, such as foam or rubber. As shown in FIG. 5, padding strip 60 spaces the gap between gate 40 and stop 48, and may be compressed therebetween to a slight extent upon the closing of gate 40. Padding strip 60 dampens vibration between gate 40 and stop 48 to prevent rattling therebetween during the running of the engine of boat 20, and also eliminates undesirable noise which would be caused by gate 40 contacting stop 48 during closing of gate 40.

Referring now to FIG. 4, a second embodiment of the gate stop of the present invention is shown and referenced generally as 84. Stop 84 is also an integral member of formed metal that is very similar to stop 42 with the difference being an inward extension 92 of the side of stop 84 attached to fence 30 and deck 24 to provide additional support for the fence 26 and the stop 84.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A pontoon boat comprising:

a flotation device including at least two pontoons and a support frame extending between said pontoons;

a deck disposed atop said support frame;

a fence disposed generally around the perimeter of the deck and mounted to said deck, said fence having inner and outer sides and a top edge;

a movable gate disposed in a gap in said fence and being hingedly connected to said fence at one side of the gap in said fence;

a latch member connected to said fence at the inner side of said fence and at an opposite side of said gap from where the gate is hingedly connected to the fence, said latch extending into the gap in said fence to selectively latch said gate in a closed position; and a stop connected to said fence at said opposite side of said gap and extending into the gap at said outer side of said fence, said stop having at least a bottom portion and a top portion, said bottom portion being disposed in proximity to said deck and said top portion being disposed in proximity to the top edge of the fence, whereby the gate is blocked from swinging outwardly at at least two vertical locations by said stop.

2. The pontoon boat of claim 1, wherein said gate stop includes an angled support member extending inwardly from said stop member and being fastened to said deck.

3. The pontoon boat of claim 1, wherein said stop comprises a rail that extends continuously from near said deck to the position proximate the top edge of said fence.

4. The pontoon boat of claim 1, wherein said hinge is a vertically sliding hinge, whereby said gate can be lifted above said latch and swung inwardly.

5. The pontoon boat of claim 1, wherein said stop includes a padding strip thereon, said padding strip disposed between said stop and said gate.

* * * * *